US006851136B2

(12) United States Patent
Brereton

(10) Patent No.: US 6,851,136 B2
(45) Date of Patent: Feb. 8, 2005

(54) ERECTABLE, COLLAPSIBLE PORTABLE STRUCTURES

(75) Inventor: Anthony Paul Brereton, Widnes (GB)

(73) Assignee: Finecard International Limited (GB)

( * ) Notice: Subject to any disclaimer, the term of this patent is extended or adjusted under 35 U.S.C. 154(b) by 0 days.

(21) Appl. No.: 10/740,190

(22) Filed: Dec. 18, 2003

(65) Prior Publication Data

US 2004/0148700 A1 Aug. 5, 2004

(30) Foreign Application Priority Data

Dec. 19, 2002 (GB) ..... 0229715

(51) Int. Cl.[7] ..... A47D 9/00

(52) U.S. Cl. ..... 5/102; 5/100; 5/93.1; 5/97; 5/98.1; 5/99.1; 135/126

(58) Field of Search ..... 5/93.1, 97, 98.1, 5/99.1, 101, 102; 135/124, 125, 126, 128

(56) References Cited

U.S. PATENT DOCUMENTS

| | | | | | |
|---|---|---|---|---|---|
| 4,569,362 | A | * | 2/1986 | Fidler, Jr. | 135/126 |
| 4,945,584 | A | * | 8/1990 | LaMantia | 5/97 |
| 5,642,750 | A | * | 7/1997 | Brown et al. | 135/137 |
| 5,816,278 | A | * | 10/1998 | Kim | 135/126 |
| 6,092,544 | A | * | 7/2000 | Zheng | 135/125 |
| 2004/0139997 | A1 | * | 7/2004 | Zheng | 135/126 |

* cited by examiner

*Primary Examiner*—Teri Pham Luu
(74) *Attorney, Agent, or Firm*—Gauthier & Connors LLP

(57) ABSTRACT

A portable "pop-up" structure comprising a first part (10) forming a receptacle, and a second part (11) forming an enclosure for the receptacle. The first and second parts are separable and each may be folded into a plurality of overlying loops for storing. Each part of the structure is made from a flexible coilable material frame with a foldable cloth-like material between the frame members. Thus, the structure forms a portable cot or animal bed which may be quickly released and erected using the "pop-up" principle, yet readily folded and stowed when not required.

11 Claims, 5 Drawing Sheets

ERECTABLE, COLLAPSIBLE PORTABLE STRUCTURES

THIS INVENTION relates to portable structures of the kind which may be readily erected to form a temporary enclosure to serve, for example, as a travel bed or pet basket, and yet may be readily collapsed and stowed in a compact form for transportation.

Many erectable/collapsible structures are available and often referred to as "pop-up" structures where the structure is readily foldable and twistable such that it collapses into a number, usually three, of superimposed rings which assume a flat configuration thus to be readily packed into a carrying bag. Such a structure is described and illustrated, for example, in EP-A-0 331 029. The present invention serves to apply the pop-up concept to a readily transportable enclosure which may be used as a child's bed or as an enclosure for a pet animal.

According to the present invention, there is provided, a portable structure operable for transforming from a collapsed configuration into an expanded configuration and thence back into said collapsed configuration, comprising:

a) a first part consisting of a pair of superimposed frames each formed from a flexible coilable material with a foldable cloth-like material between them such as to form a wall when the frames are separated by the extent of the foldable cloth-like material;

b) a second part consisting of a frame formed from a flexible coilable material, said frame having, when in an expanded in-use configuration, a shape of a figure-of-eight thereby defining first and second loops and a cross-over said cross-over forming an apex of said second part and the loops extending downwardly therefrom, first and second side panels being formed from a foldable cloth-like material, said side panels spanning said first and second loops respectively; and c) means for removably connecting the first and second parts such that the first part forms a receptacle for containment of articles or beings, with the second part forming a cover for the receptacle;

both first and second parts being individually foldable and collapsible, each into several overlying loops and, when so collapsed, being expandable by spreading said loops apart and allowing said frames to spring into said expanded configuration.

Preferably, said second part has a third panel formed from a foldable cloth-like material and extending between the first and second loops to form a back panel when the second part is in the expanded configuration.

A fourth panel formed from a foldable cloth-like material may be attached at one edge thereof to one of said first and second loops and may have remote edges removably attachable respectively to the other of said first and second loops and to an upper region of the wall of said first part of the structure, thus to form an openable front panel for the receptacle.

One of the side panels of the second part may include a pocket for receiving the material of the front panel when the latter is in an open condition.

At least a part of said remote edges of said front panel may be closable with respect to the second part by means of a sliding clasp fastener.

At least a part of the remote edges of the front panel may be attachable to an upper region of the wall of the first part by an elasticated edge region.

The means for removably connecting the first and second parts may be press-studs.

The means for removably connecting the first and second parts may be hook and loop fastener.

At least a part of at least one of the side, back and front panels, may be of a reticulate material for ventilation.

An embodiment of the invention will now be described, by way of example only, with reference to the accompanying drawings, in which.

Figure 1:
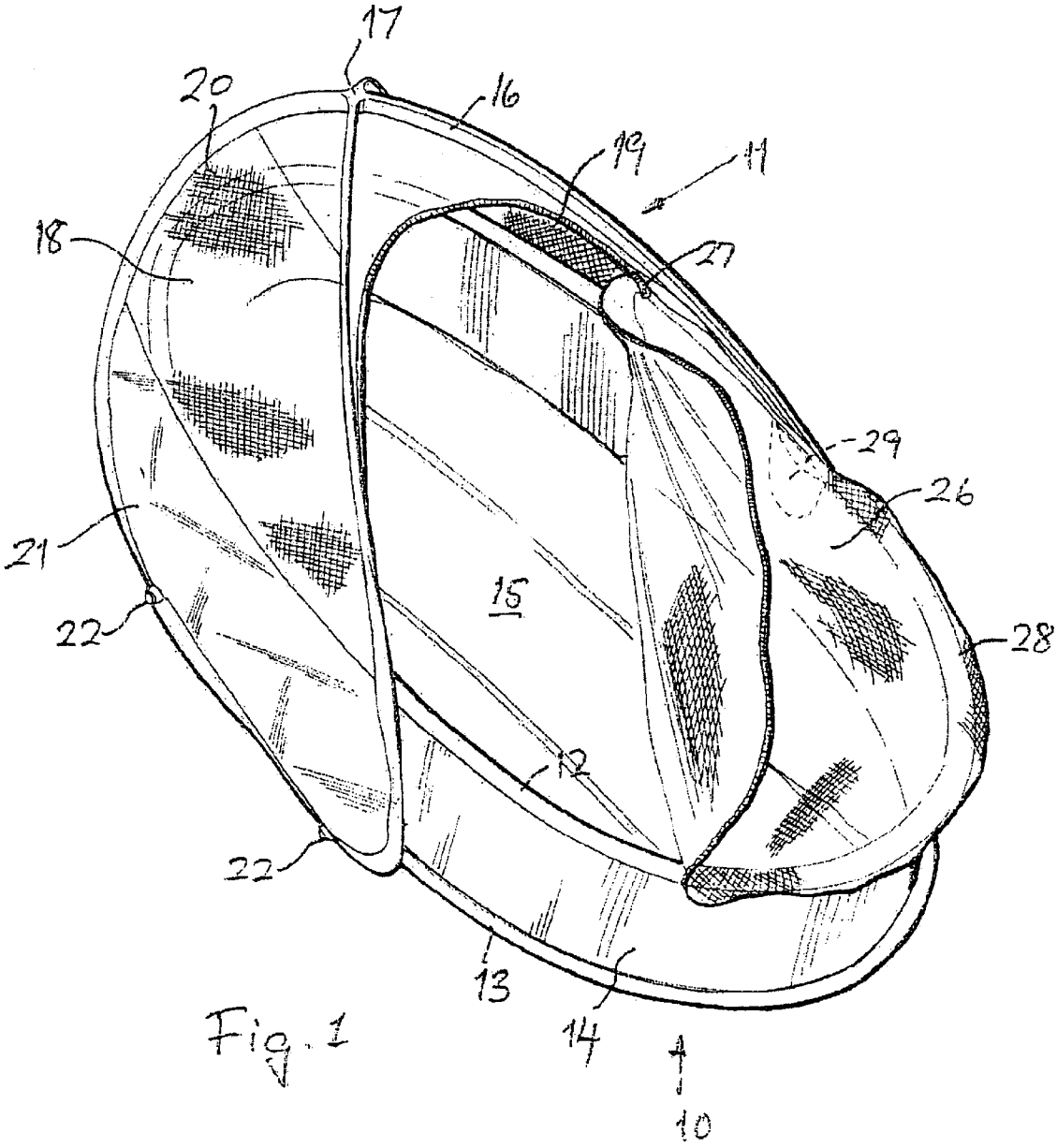
FIG. 1 is a perspective view of a portable structure made in accordance with the invention taken from a frontal region of the structure.

Referring now to the drawings, the structure comprises a first part 10 and a second part 11 attached thereto to form, in this example, a baby's portable cot. The first part 10 consists of a pair of superimposed frames 12 and 13 each formed from a flexible coilable material such as spring steel with a foldable cloth-like material wall 14 between them. The frames 12, 13 are each contained within a fabric sleeve sewn to the respective opposed edges of the wall 14.

Within the bounds of the lower frame 13 may be sewn a foldable cloth-like base sheet 15 which, if required, may receive a removable resilient cushion to form a mattress.

The second part 11 of the structure comprises a frame 16 once again formed from a flexible coilable material contained within a fabric sleeve. The frame 16, as shown in FIG. 1, assumes the shape of a figure-of-eight thereby defining first and second loops located on opposite sides respectively of the cross-over 17 so that the latter forms an apex of the second part of the structure and the loops extend downwardly therefrom to the same level as the frame 13 of the first part i.e. down to the floor upon which the structure will stand.

Also defined by the second part of the structure 16 are first and second side panels 18 and 19 formed from a foldable cloth-like material an upper part 20 of each side panel being of a mesh-like material for ventilation while the lower part 21 may be of an opaque material such as PVC or a cellulosic fabric.

Figure 2:
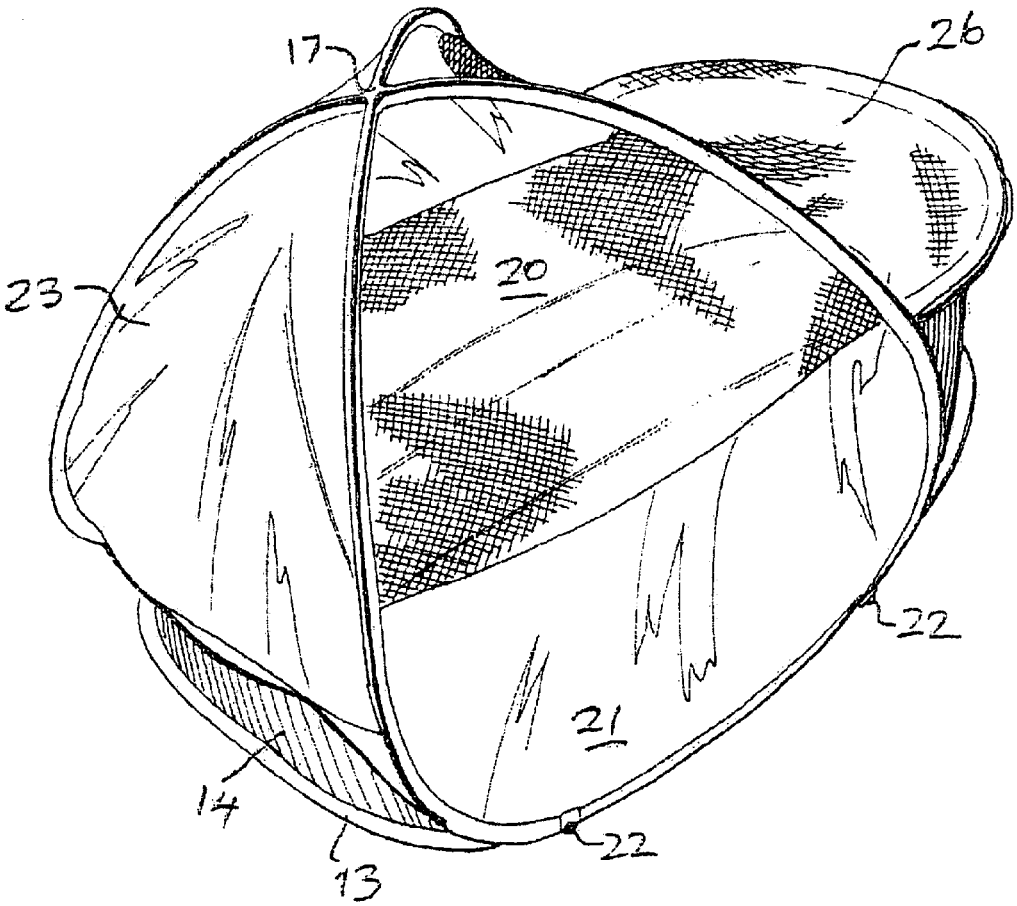
FIG. 2 is a further perspective view of the structure taken from a rearward region of the structure.
Figure 3:
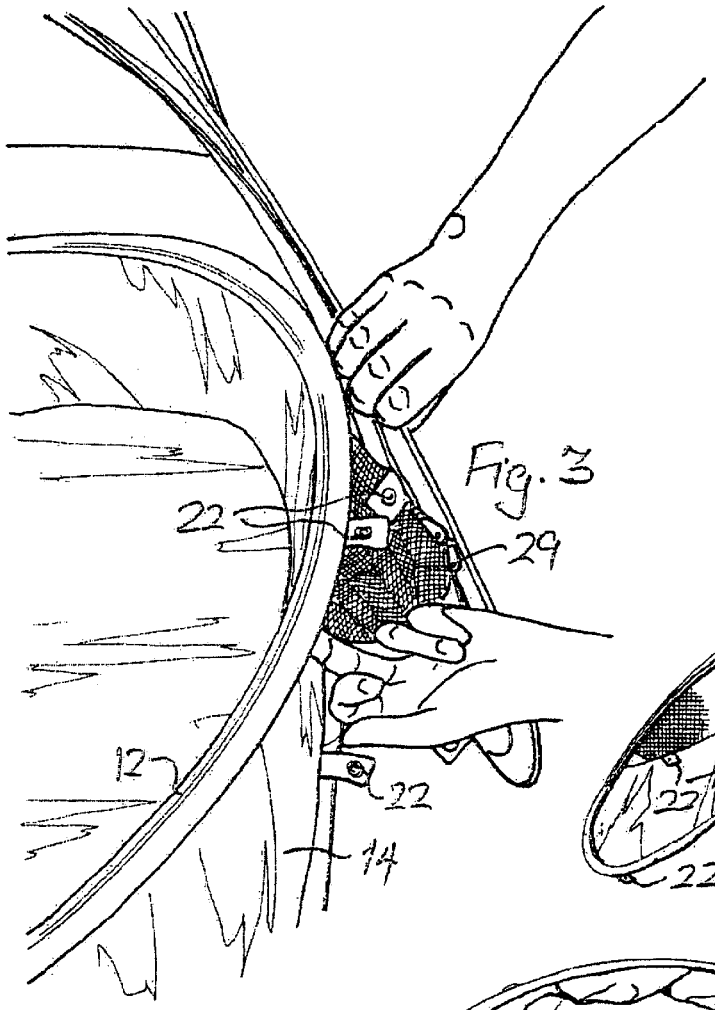
FIG. 3 is a partial view of the structure illustrating a pocket for storage of a front panel thereof.
Figure 4:
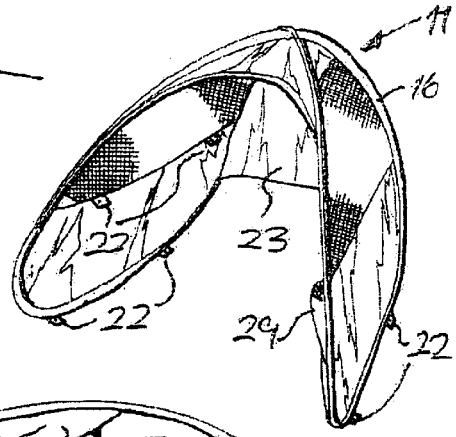
FIG. 4 is a view of the structure showing first and second parts thereof separated for folding and storage.
Figure 4:
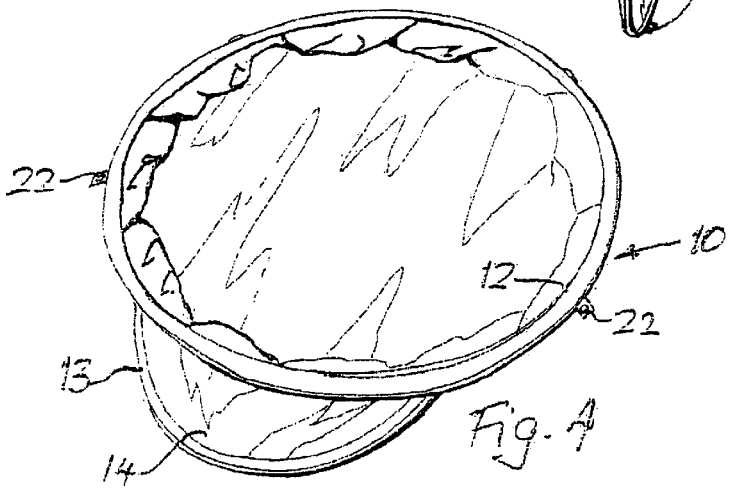

By virtue of a number of press-studs 22 (or hook and loop fastener) respective parts of which are disposed on the first and second parts of the structure respectively, so the wall 14 of the first part is held in the expanded configuration as illustrated in FIGS. 1 and 2.

A back panel 23 as shown in FIG. 2 is attached by sewing to the fabric sleeve surrounding the figure-of-eight framework 16 and this, if required, may be entirely of opaque material similar to the lower part 21 of each side panel.

A front panel comprises an upper section sewn in a similar manner as the panel 23, to the framework 16, and a foldable mesh lower part 26 which is closable against the structure by means of a sliding clasp fastener 27 and by virtue of its having an elasticated front edge 28 which when the fastener 27 is closed may be passed over the upper edge of the frame 12 of the first part of the structure so that the front panel thereby forms a closure of the structure which nevertheless may be opened as shown in FIG. 1 and rolled back and deposited into a pocket 29 attached to one side panel of the second part 11 of the structure.

When it is required to collapse the structure for storage, the press-studs 22 are released to separate the first and second parts 10 and 11 of the structure. Once the press-studs are released the wall 14 of the first part collapses so that the frames 12 and 13 thereof become closely superimposed.

Figure 5:
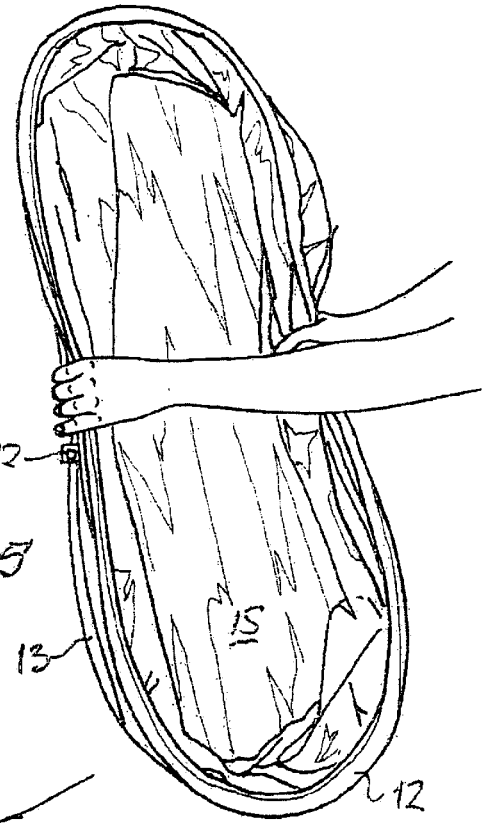
FIGS. 5 and 6 illustrate a procedure for folding the first part of the structure for storage.
Figure 6:
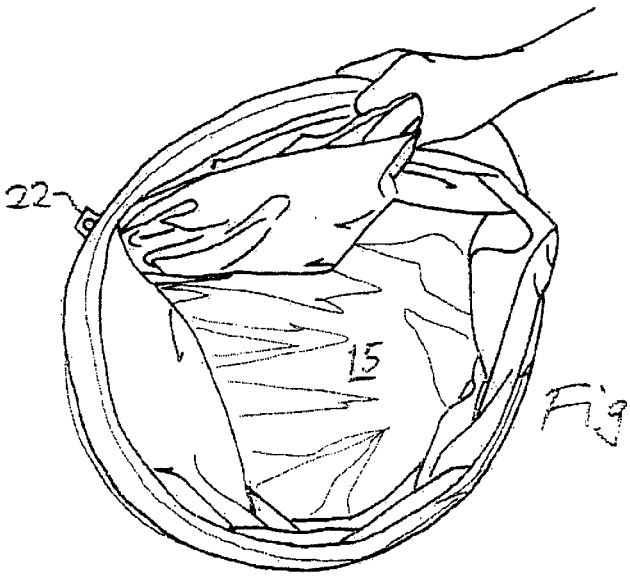

Referring now to FIGS. 5 and 6 it will be seen that opposed sides of the frames 12 and 13 may be squeezed together and twisted thus to form six overlying loops as shown in FIG. 6 with the fabric walls and base sheet also folded flat so that the first part of the structure may be inserted into a carrying bag.

Figure 7:
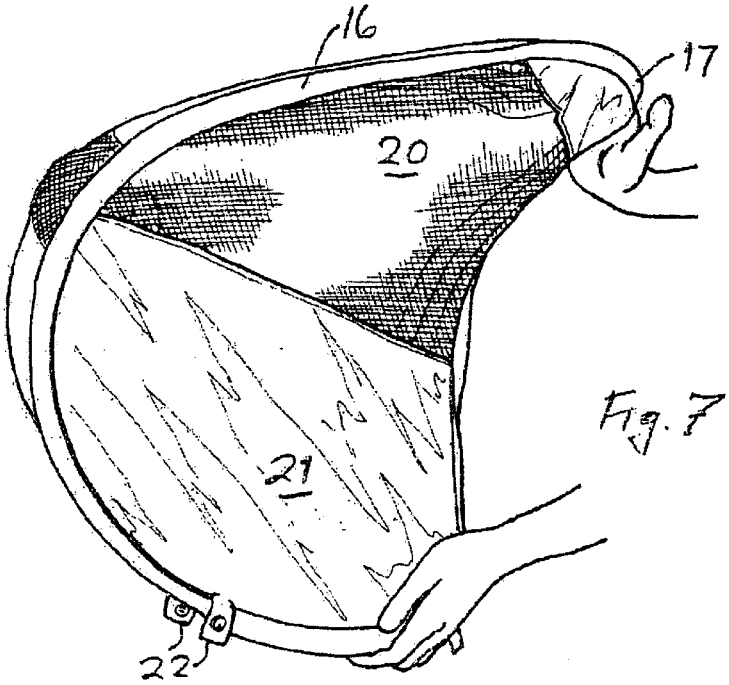
FIGS. 7, 8 and 9 illustrate a procedure for folding the second part of the structure for storage.
Figure 8:
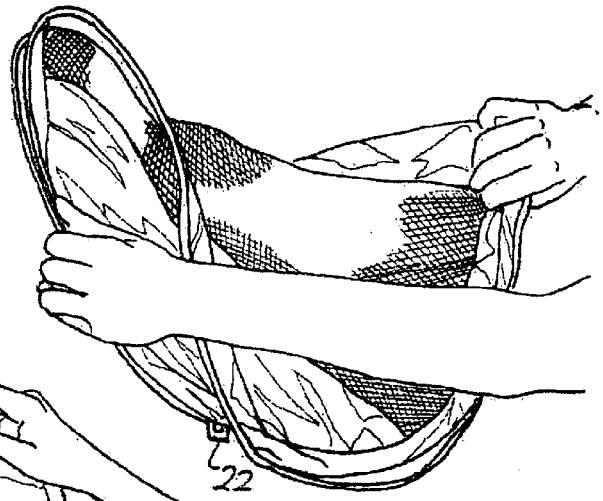
Figure 9:
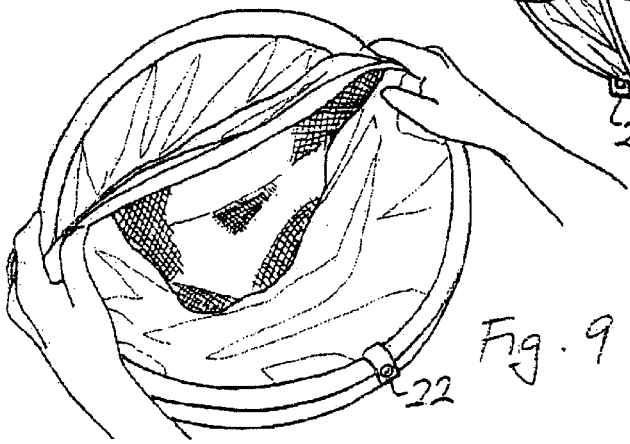

Referring now to FIGS. 7 to 9, in a somewhat similar manner, the second part 11 of the structure is folded firstly by closely superimposing the two side panels and then folding and twisting same once again to form a superimposed arrangement of six overlying loops which may be stored in the same bag as the first part 10.

This folding and twisting technique is well known in structures of this general kind as illustrated and described in EP-A-0331029.

It will be seen that a structure made in accordance with the invention provides a readily erectable and collapsible portable structure which may serve as a baby's temporary cot for use when travelling, or alternatively as an enclosure to form a pet bed. Conceivably, such a structure may also be used for the temporary storage of foodstuffs to prevent contamination thereof by insects and the like. While a substantial portion of the second part of the structure is of a mesh material for the purpose of ventilation, nevertheless the entire structure may be of an opaque material if it is required that the contents or occupants should be kept in a darkened environment. Alternatively, all cloth-like parts of the structure may be of a transparent or reticulate material.

What is claimed is:

1. A portable structure operable for transforming from a collapsed configuration into an expanded configuration and thence back into said collapsed configuration, comprising:

a) a first part consisting of a pair of superimposed frames each formed from a flexible coilable material with a foldable cloth-like material between them such as to form a wall when the frames are separated by the extent of the foldable cloth-like material;

b) a second part consisting of a frame formed from a flexible coilable material, said frame having, when in an expanded in-use configuration, a shape of a figure-of-eight thereby defining first and second loops and a cross-over said cross-over forming an apex of said second part and the loops extending downwardly therefrom, first and second side panels being formed from a foldable cloth-like material, said side panels spanning said first and second loops respectively; and c) means for removably connecting the first and second parts such that the first part forms a receptacle for containment of articles or beings, with the second part forming a cover for the receptacle;

d) both first and second parts being individually foldable and collapsible, each into several overlying loops and, when so collapsed, being expandable by spreading said loops apart and allowing said frames to spring into said expanded configuration.

2. A portable structure according to claim 1, wherein said second part has a third panel formed from a foldable cloth-like material and extending between the first and second loops to form a back panel when the second part is in the expanded configuration.

3. A portable structure according to claim 2, including a fourth panel formed from a foldable cloth-like material attached at one edge thereof to one of said first and second loops and having remote edges removably attachable respectively to the other said first and second loops and to an upper region of the wall of said first part of the structure, thus to form an openable front panel for the receptacle.

4. A portable structure according to claim 3, wherein one of the side panels of the second part includes a pocket for receiving the material of the front panel when the latter is in an open-condition.

5. A portable structure according to claim 3, wherein at least a part of said remote edges of said front panel is closable with respect to the second part by means of a sliding clasp fastener.

6. A portable structure according to claim 3, wherein at least a part of the remote edges of the front panel is attachable to an upper region of the wall of the first part by an elasticated edge region.

7. A portable structure according to claim 3, wherein at least a part of at least one of the side, back and front panels, is of a reticulate material for ventilation.

8. A portable structure according to claim 1, wherein the means for removably connecting the first and second parts is a hook and loop fastener.

9. A portable structure according to claim 1, wherein the means for removably connecting the first and second parts are press-studs.

10. A portable structure according to claim 1, wherein the frames of the first and second parts are each contained within a fabric sleeve sewn to the respective opposed edges of the foldable cloth-like material.

11. A portable structure according to claim 1, wherein a lower region of the first part includes a foldable cloth-like base sheet attached to the lower region of the wall to form a base for the structure.

* * * * *